US012557963B1

(12) United States Patent
Jia

(10) Patent No.: US 12,557,963 B1
(45) Date of Patent: Feb. 24, 2026

(54) MOP CLEANING DEVICE WITH VISUALIZED WATER SPRAYING STATE

(71) Applicant: Xinghang Jia, Yongkang (CN)

(72) Inventor: Xinghang Jia, Yongkang (CN)

(73) Assignee: Xinghang Jia (CN)

( * ) Notice: Subject to any disclaimer, the term of this patent is extended or adjusted under 35 U.S.C. 154(b) by 0 days.

(21) Appl. No.: 18/605,720

(22) Filed: Mar. 14, 2024

(30) Foreign Application Priority Data

Jun. 29, 2023 (CN) ..... 202321680174.8

(51) Int. Cl.
*A47L 13/58* (2006.01)
*A47L 13/59* (2006.01)

(52) U.S. Cl.
CPC ..... *A47L 13/58* (2013.01); *A47L 13/59* (2013.01)

(58) Field of Classification Search
CPC ..... A47L 13/58; A47L 10/2025; A47L 13/59
See application file for complete search history.

(56) References Cited

U.S. PATENT DOCUMENTS 11,771,284 B2 10/2023 Pruiett et al.

FOREIGN PATENT DOCUMENTS

| | | | | | |
|---|---|---|---|---|---|
| CN | 113197528 A | * | 8/2021 | ..... | A47L 13/20 |
| CN | 215993884 U | * | 3/2022 | ..... | A47L 13/59 |
| CN | 220236814 U | * | 12/2023 | ..... | A47L 13/59 |
| CN | 220512818 U | * | 2/2024 | ..... | A47L 13/59 |

* cited by examiner

*Primary Examiner* — Laura C Guidotti

(74) *Attorney, Agent, or Firm* — Amster Rothstein & Ebenstein LLP; Charles C. Achkar

(57) ABSTRACT

A mop cleaning device with visualized water spraying state includes a flat mop and a mop bucket; the flat mop comprises a mop rod, a mop head, and a wiping cloth; the mop bucket comprises the water storage area, the cleaning area, and the pumping device; the cleaning area has the squeezing device and the cleaning port, the pumping device sprays water from the water storage area onto the wiping cloth for cleaning, and the cleaning port is provided with the squeezer and the supporting device, the support device can adjust the distance between the wiping cloth and squeezer, and the pumping device is provided with the visible window and the prompt device, the prompt device can move under the driving force of the water flow of the pumping device, and the position information or activity status of the prompt device can be displayed through the visible window.

9 Claims, 9 Drawing Sheets

MOP CLEANING DEVICE WITH VISUALIZED WATER SPRAYING STATE

FIELD OF THE INVENTION

The present invention relates to the field of daily cleaning, specifically to a mop cleaning device with visualized water spraying state.

BACKGROUND OF THE INVENTION

Flat mop is a common floor cleaning tool in daily life, which is usually used together with a mop bucket. After cleaning the floor, the flat mop is placed in the mop bucket for cleaning and dehydration. The existing mop bucket includes independent squeezing and cleaning areas, the cleaning and squeezing of the flat mop are carried out in two different areas, but the same water is always used for cleaning. After one or more cleaning, the water will become dirty and reduce the cleaning efficiency.

To solve the above problems, Chinese patent (Patent No.: CN216984814U) discloses a multifunctional mop cleaning device, the mop bucket of this patent is provided with a water storage chamber and a water supply mechanism to supply clean water for cleaning, thereby improving the cleaning efficiency of the mop. However, when cleaning the mop, the mop cleaning device cannot be checked whether the water supply mechanism is spraying water, the user needs to open the water storage chamber to observe the water level or contact the wiping cloth to check the spraying situation of the water supply mechanism. Moreover, when cleaning and dehydrating the mop, the resistance between the mop movement and the squeezing mechanism cannot be changed, making it difficult for the mop to clean and dehydrate.

SUMMARY OF THE DISCLOSURE

Therefore, the present invention provides a mop cleaning device with visualized water spraying state to solve the above-mentioned problems.

To achieve the above purpose, the present invention provides the following technical solutions:

A mop cleaning device with visualized water spraying state, comprising the flat mop and the mop bucket, the flat mop includes the mop rod, the mop head and the wiping cloths, the mop bucket includes the water storage area and the cleaning area, the water storage area is connected to the cleaning area through the pumping device, the squeezing device is provided within the cleaning area, the squeezing device is provided with the cleaning port, the flat mop drive the pumping device to spray water from the water storage area onto the wiping cloth for cleaning. The squeezer and support part are provided on the opposite sides of the cleaning port and work together to support the mop head. The support part can come into contact with different positions of the mop head, in order to adjust the distance between the wiping cloth and the squeezer, which is convenient to adjust the tightness of the mop head during cleaning and squeezing. Thereby the mop head can move up and down easily during cleaning, the contact between the mop head and the squeezer is tighter during squeezing and easier for the wiping material to dehydrate.

Preferably, at least one support groove is provided in the length direction of the mop head. During cleaning, the mop head passes through the cleaning port, and the support part extends into the support groove to support the mop head;

During squeezing, the support part is supported on the surface of the mop head, so that the distance between the wiping cloth and the squeezer during squeezing is smaller than that during cleaning. During cleaning, simply contact the wiping cloth with the squeezer, the stains on the wiping cloth can be cleaned through the friction between the squeezer and the wiping cloth. However, during squeezing, the contact between the squeezer and the wiping cloth needs to be closer to squeeze the water in the wiping cloth. Therefore, the distance difference between the wiping cloth and the squeezer during cleaning and squeezing can meet the requirements of cleaning and squeezing, and it is more labor-saving to use.

Preferably, the length of the cleaning port is longer than the width of the mop head. When the support groove is aligned with the position of support part and inserted, the flat mop enters into the cleaning state. When the support groove is inserted away from the position of the support part, the support part supports the surface of the mop head, and the flat mop enters the squeezing water state.

Preferably, the length of the cleaning port is matched with the width of the mop head, and the support groove is provided at the eccentric position of the mop head. During cleaning, the mop head is rotated in the first direction to be parallel to the mop rod, when the mop head passes through the cleaning port, the support part extends into the support groove. During squeezing, the mop head is rotated in the second direction opposite to the first direction to be parallel to the mop rod, when the mop head passes through the cleaning port, the support part is supported on the surface of the mop head. By changing the position between the support part and the support groove or other positions of the mop head, the distance between the wiping cloth and the squeezer can be adjusted, further to adjust the tightness between the wiping cloth and the squeezer.

A mop cleaning device with visualized water spraying state, comprising the flat mop and the mop bucket, the flat mop includes the mop rod, the mop head and the wiping cloths, the mop bucket includes the water storage area and the cleaning area, the water storage area is connected to the cleaning area through the pumping device, the squeezing device is provided within the cleaning area, the squeezing device is provided with the cleaning port, which is characterized in that, the flat mop drive the pumping device to spray water from the water storage area onto the wiping cloth for cleaning, the squeezer and support part are provided on the opposite sides of the cleaning port and work together to support the mop head, the support part come into contact with different positions of the mop head to adjust the distance between the wiping cloth and the squeezer; the visual window and the prompt device are provided on the pumping device, the prompt device move under the driving force of the water flow of the pumping device, when pumping device is pumping water or stops pumping, the position information or activity status of prompt device could be displayed through visual window. When cleaning the mop, users can check whether the pumping device is pumping water through the information displayed in the visual window, thereby determining whether the water storage area is short of water or whether the pumping water path is blocked. This avoids the situation that the wiping cloth still moving up and down when the pumping device doesn't work, the cleaning function cannot be achieved due to failure to obtain water spray information in a timely manner.

Preferably, the prompt device is rotatably installed in the visual window, the prompt device is stationary when the pumping device stops pumping, and the water flow drives the prompt device to rotate when the pumping device is pumping.

Preferably, the prompt device is placed or installed floatable, the prompt device is located at upstream when the pumping device stops pumping, the water flow drives the prompt device to move downstream when the pumping device is pumping. The position information displayed in the visual window is different before and after the activity of prompt device, users can check whether the pumping device is working by observing the dynamic information or the position information before and after the activity of prompt device, this information can be obtained timely when cleaning the mop.

Preferably, at least two different colors are provided at different positions of the prompt device, and the colors displayed in the visible window are different when the prompt device is stationary and rotating. The spraying information can be more intuitively by the different colors displayed on the prompt device under the action of water flow.

Preferably, a transparent cover is on the visible window, the cover can prevent water spraying out of the visible window, and the information of the prompt device can be observed through the cover from the outside.

Preferably, the pumping device further comprises the pumping sensor, the pumping pump, and the pumping power source. The pumping sensor receive the signal of flat mop entered into the cleaning area, in order to drive the pumping pump to work and pump water. The pumping sensor can be provided as photoconduction or mechanically conduction. Through the cleaning action of the mop, the water spraying can be controlled automatically, making it more convenient to use.

Preferably, the pumping power source includes the pumping gear, the pumping gear is arranged between the cleaning area and the water storage area, and at least part of the pumping gear are arranged within the cleaning area, the eccentric position of the pumping gear is movably connected to the pumping connecting rod, and the other end of the pumping connecting rod is movably connected to the pump core of the pumping pump, the length direction of the mop head is provided with the first gear rack. When the mop head passes through the cleaning port, the first gear rack meshes with the pumping gear, the mop head move up and down, further drive the pumping pump to pump water through the pumping power source. The transmission of the gear rack and pumping gear can control the speed of water spraying through the downward movement speed of the mop.

Preferably, the spray head and the pumping gear are arranged in different directions of the cleaning port, the spray head is connected to the pumping pump through the pumping water path, the spray head is provided with the spray nozzle, which spray the water pumped by the pumping pump onto the wiping cloth, and the height of the spray nozzle is not lower than the height of the pumping pump.

Preferably, the cleaning and squeezing of the flat mop are completed within the cleaning area, the bottom of the cleaning area is provided with the protrusions or the surrounding frame, the sewage generated by the cleaning and squeezing of the flat mop flows downwards to the bottom of the cleaning area.

Preferably, the mop bucket is provided with the sewage area, and the sewage generated by the cleaning and squeezing of the flat mop in the cleaning area flows to the sewage area.

The advantage of the present invention is: By providing the pumping device, the wiping cloth is cleaned with clean water, the visual window and the prompt device are provided on the pumping water path or spray head, the prompt device move under the driving force of the water flow of the pumping device, this makes it easier for users to observe the dynamic information or position change information in the visual window when cleaning mops, in order to check whether the pumping device is pumping water, which it more convenient to use. In addition, by adjusting the tightness of the mop head during cleaning and squeezing, the mop head can move up and down easily during cleaning, the contact between the mop head and the squeezer is tighter during squeezing, making it easier for the wiping cloth to dehydrate.

DETAILED DESCRIPTION OF THE PREFERRED EMBODIMENTS

Hereinafter, embodiments of the present invention will be described in detail with reference to the accompanying drawings, the present invention should not be construed as being limited to the description of the following embodiments.

In the present invention, the use of orientation words such as "lower", "outside", "vertical" are only for the convenience of description, rather than indicating or implying the specific orientation, therefore it should not be construed as being limited to the description of the following embodiments. In addition, it should be noted that the terms "first", "second" and the like in the description and claims of the present invention and the above drawings are used to distinguish similar objects, which are not necessarily used to describe the specific order or sequence. It is to be understood that the data so used are interchangeable under appropriate circumstances in order to describe the embodiments of the invention herein.

Unless otherwise stated, it should be noted that the terms "provided" and "connected" should be understood broadly. For example, "connected" could be fixed connection, detachable connection, integral connection, mechanical connection, electrical connection, direct connection, or indirect connection through the intermediate structure. For those skill in the art, the specific meanings of the above terms in the present invention should be understood in specific situations.

Figure 1:
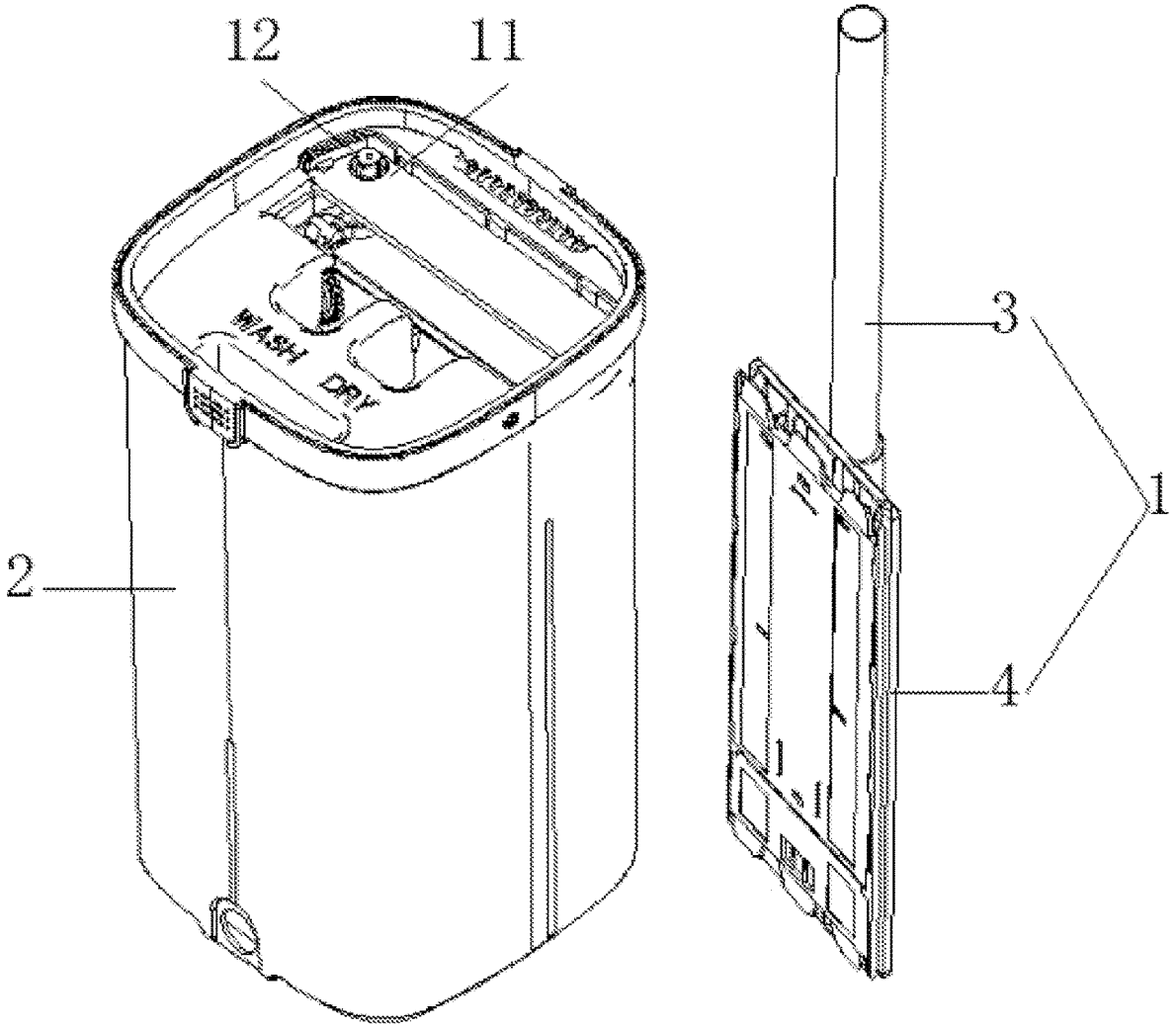
FIG. 1 is the perspective view of the mop cleaning device.
Figure 2:
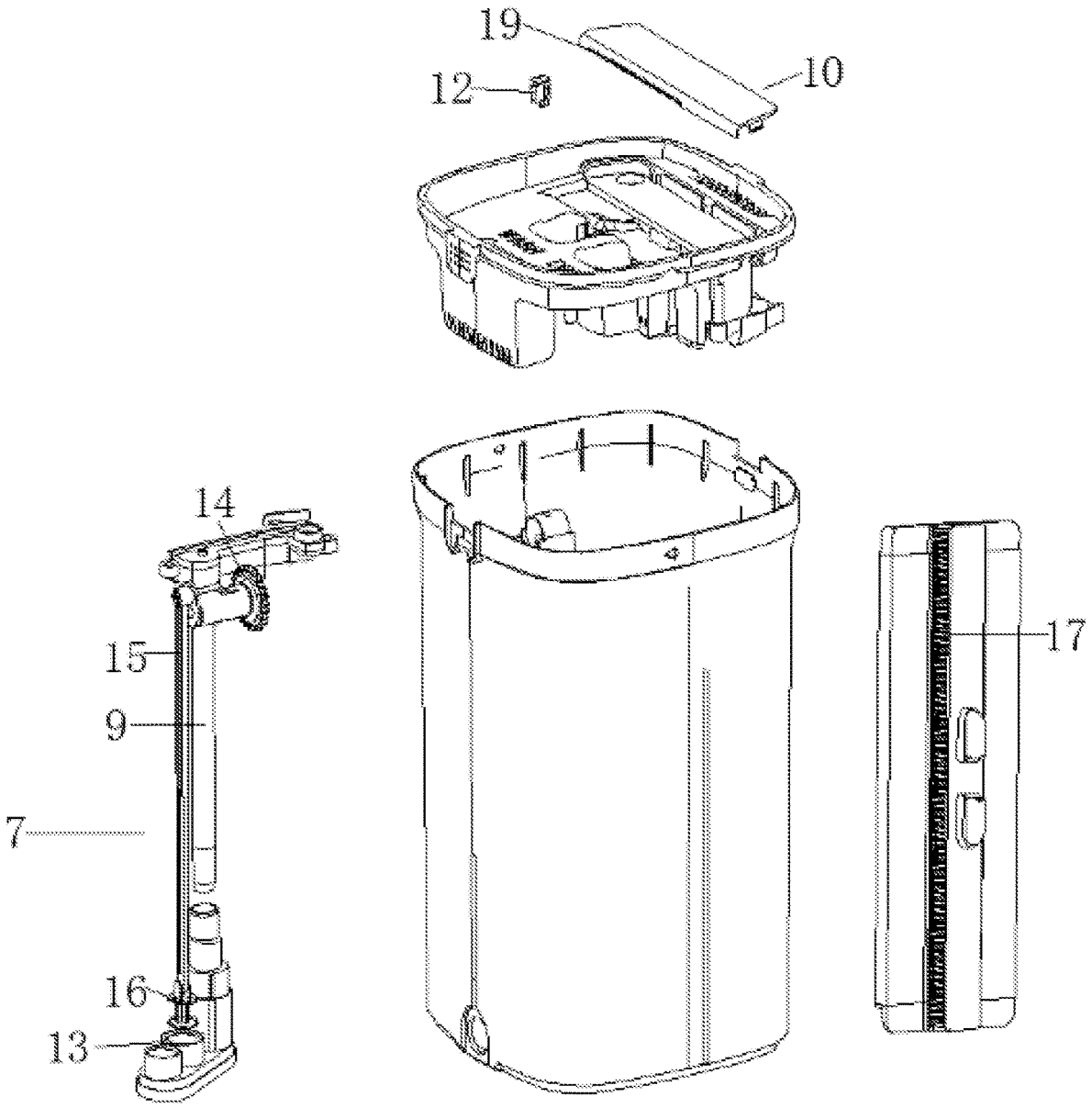
FIG. 2 is the exploded schematic view of the of the mop bucket.
Figure 3:
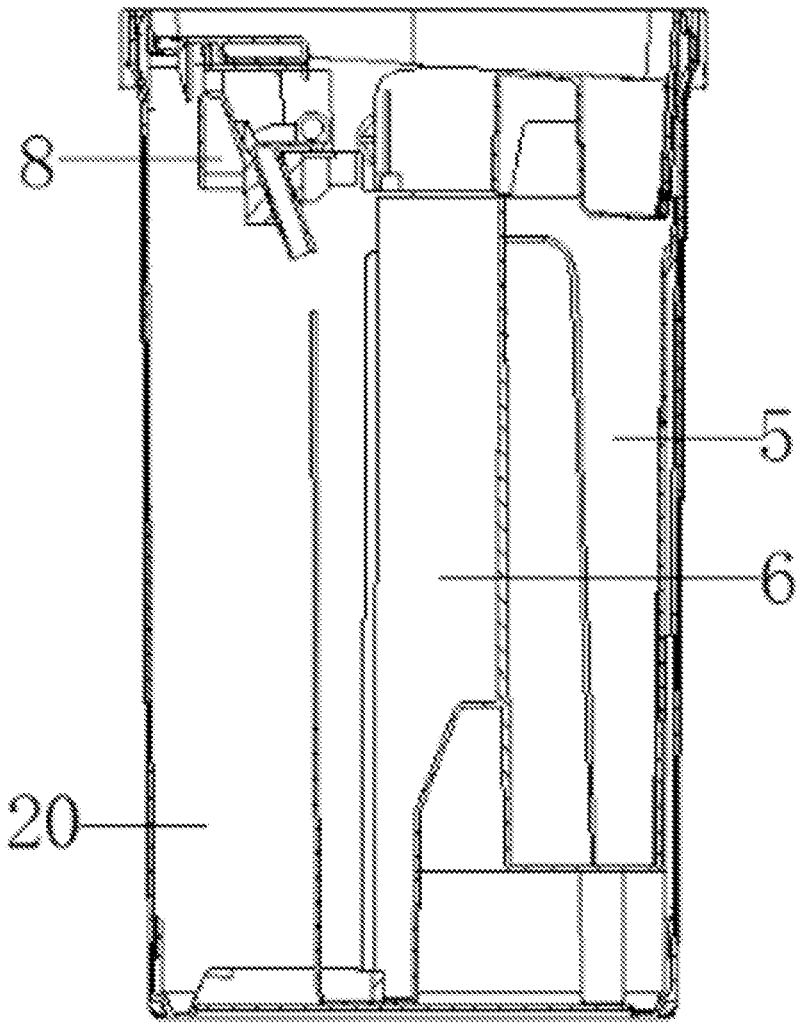
FIG. 3 is the sectional schematic view of the mop bucket with sewage area.
Figure 4:
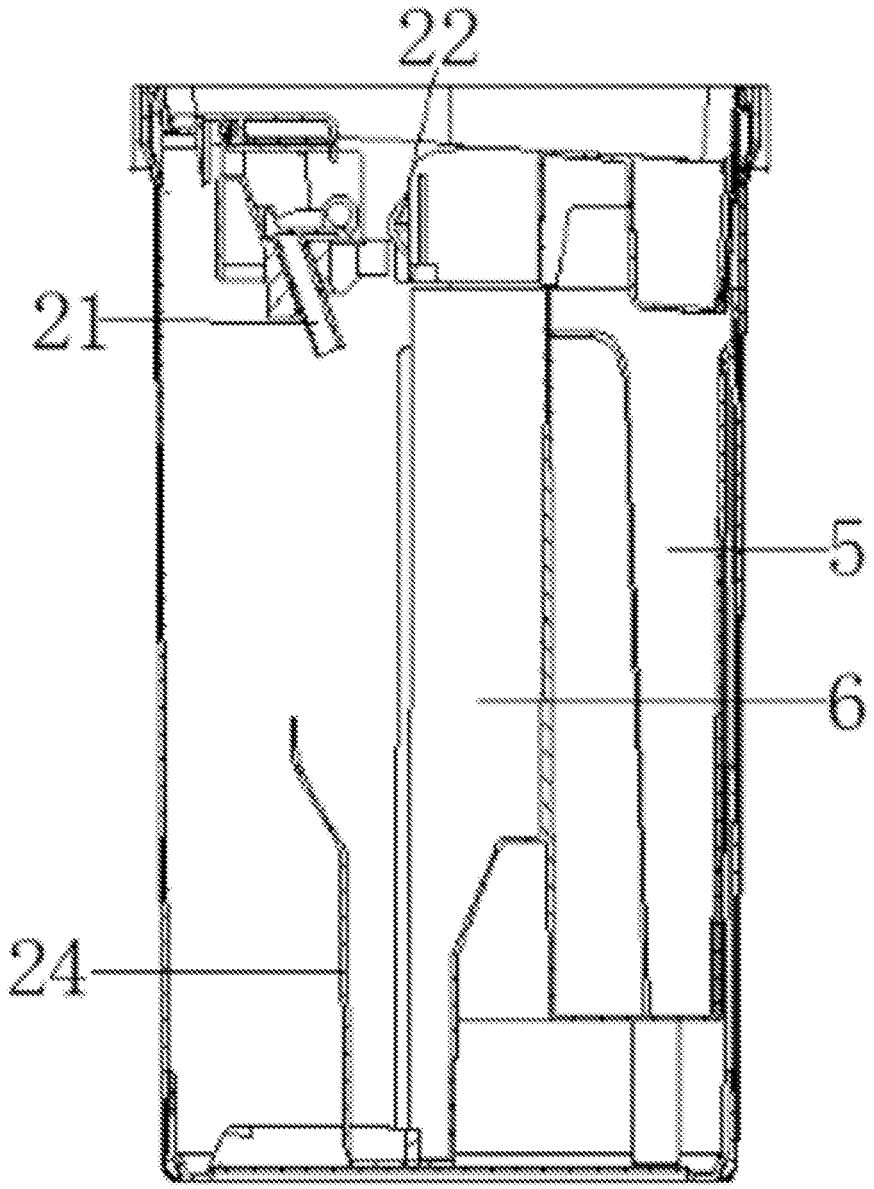
FIG. 4 is the sectional schematic view of the mop bucket with surrounding frame.
Figure 5:
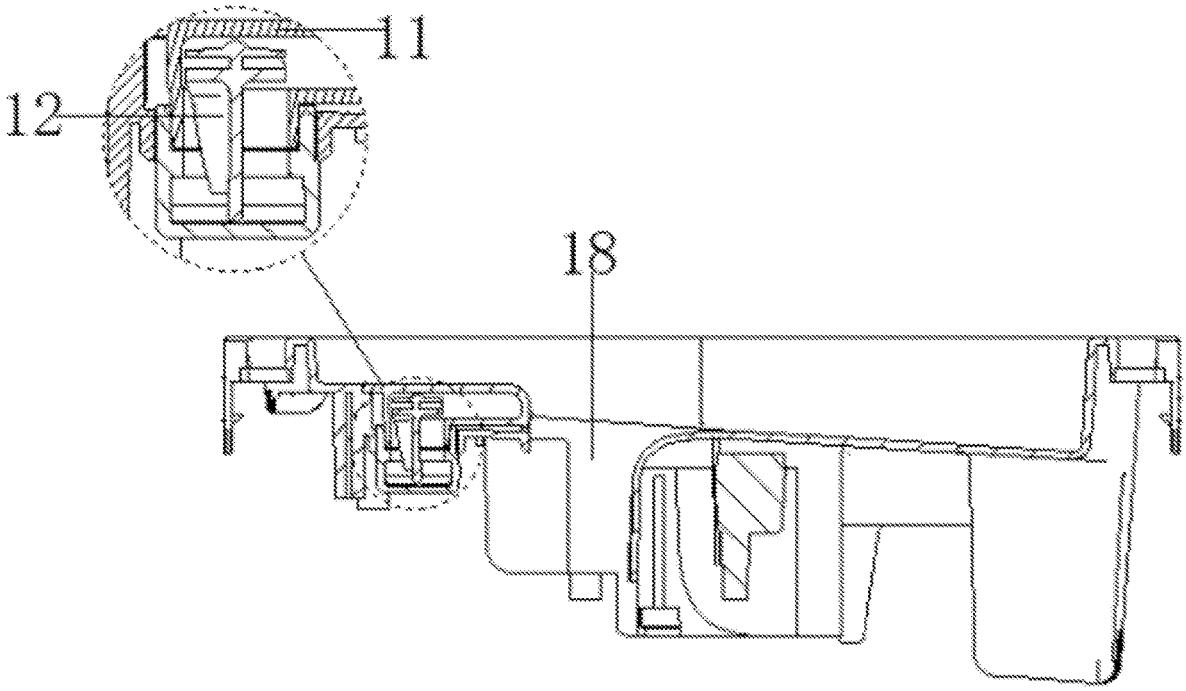
FIG. 5 is the partial enlargement diagram of the squeezing device.
Figure 6:
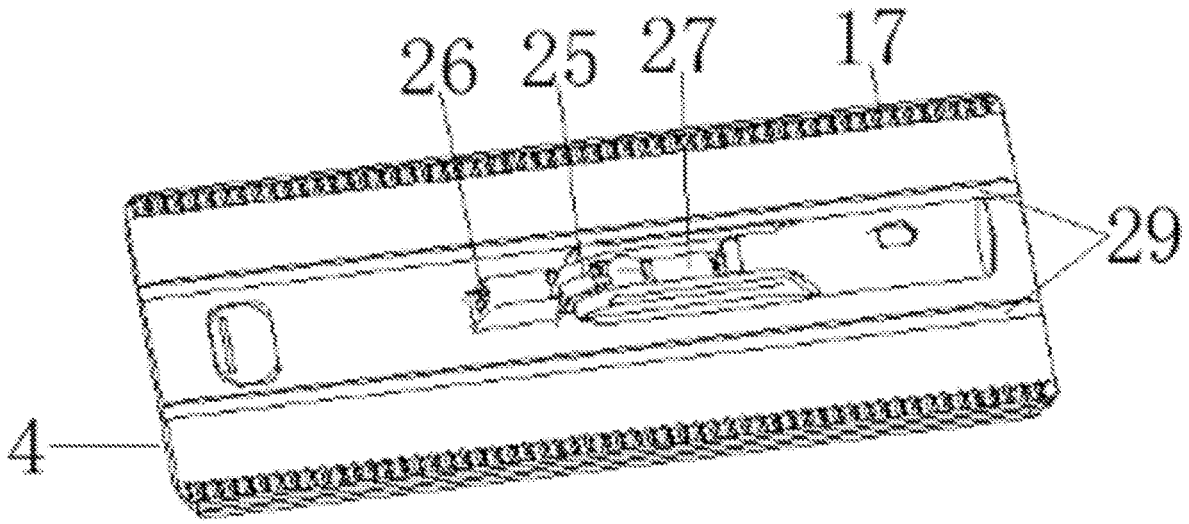
FIG. 6 is the perspective view of the mop head.
Figure 7:
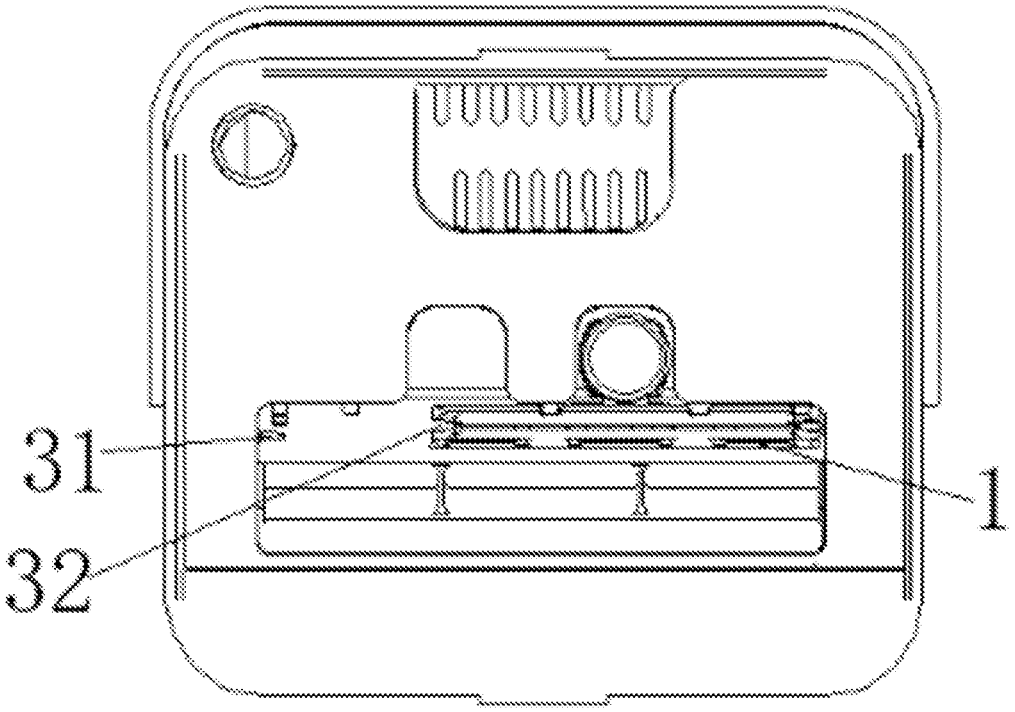
FIG. 7 is the top view of the flat mop under cleaning state.
Figure 8:
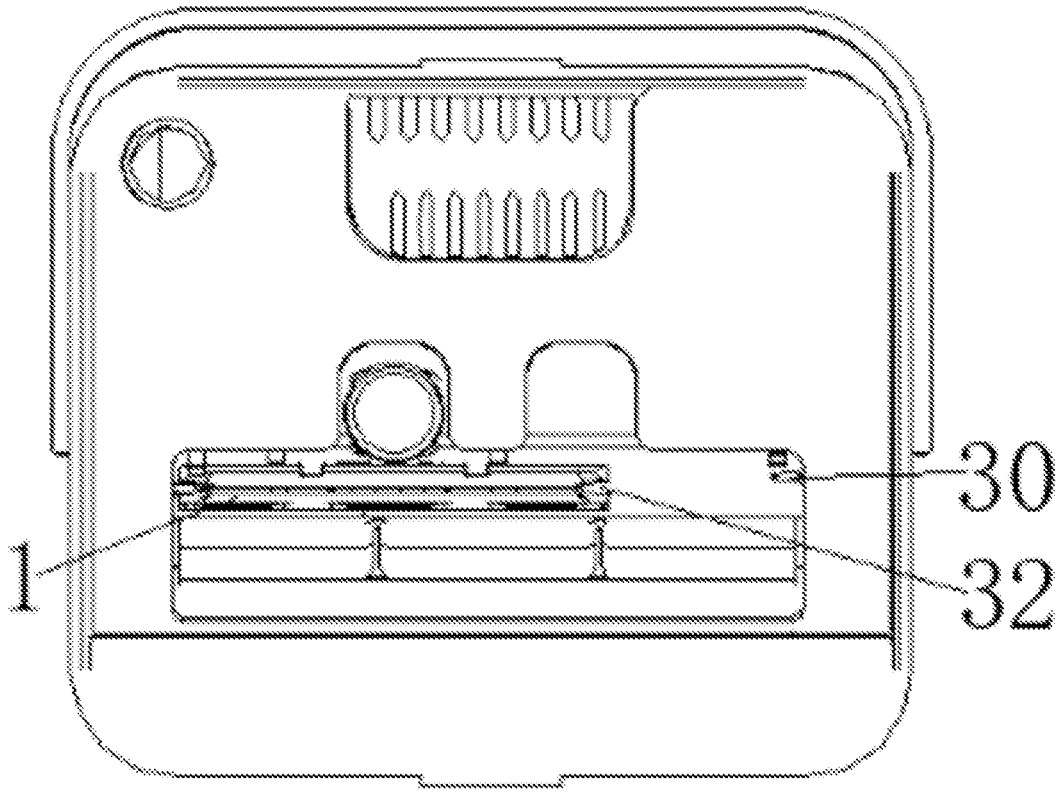
FIG. 8 is the top view of the flat mop under squeezing state.
Figure 9:
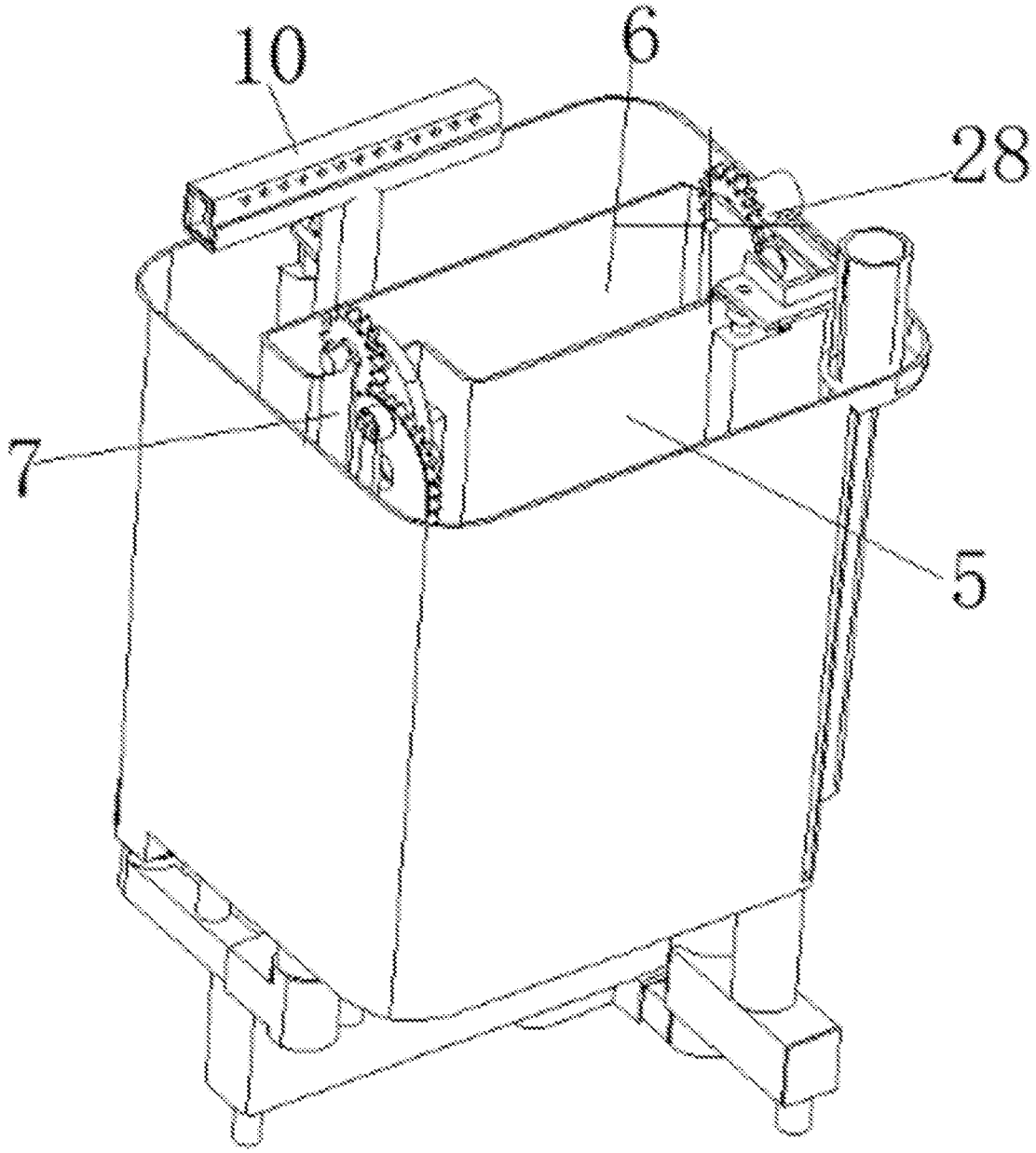
FIG. 9 is the perspective view of the water storage area.

As shown in FIGS. 1-9, a mop cleaning device with visualized water spraying state includes the flat mop 1 and the mop bucket 2; the flat mop 1 includes the mop rod 3, the mop head 4, the wiping cloth on the mop head 4; the mop bucket 2 includes the water storage area 5 and the cleaning area 6, the water storage area 5 is connected to the cleaning area 6 through the pumping device 7, the squeezing device 8 is provided above the cleaning area 6, the squeezing device 8 is provided with the cleaning port 18 for the flat mop 1 to be inserted, the squeezer 21 and support part 22 are provided on the opposite sides of the cleaning port 18, the squeezer 21 and support part 22 work together to support the mop head 4, and the support part 22 come into contact with different positions of the mop head 4 to adjust the distance between the wiping cloth and the squeezer 21, the mop head 4 controls the working state of the pumping device 7, allowing the mop head 4 to switch between cleaning state and squeezing state.

Preferably, in order to observe the pumping status of the pumping device 7 and whether the pumping device 7 is pumping water, the visual window 11 is provided on the pumping device 7, which facilitates users to observe the working status of the pumping device 7 through the visual window 11. Specifically, the pumping device 7 includes the pumping water path 9 and the spray head 10, the pumping water path 9 or spray head 10 is provided with the visual window 11, the visual window 11 is provided with the prompt device 12, the prompt device 12 move under the driving force of the water flow of the pumping device 7, when pumping device 7 is pumping water or stops pumping, the position information or activity status of prompt device 12 could be displayed through visual window 11.

In this embodiment, the visual window 11 is provided at the top of the mop bucket 2, when the user cleans the flat mop 1 up and down, the information of the prompt device 12 could be directly observed through the visual window 11, the prompt device 12 is rotatably installed in the visual window 11. The prompt device 12 is stationary when the pumping device 7 stops pumping, and the water flow drives the prompt device 12 to rotate when the pumping device 7 pumps.

Specifically, the prompt device 12 is provided with fan blades or the prompt device 12 is provided in the shape of the impeller, the pumping water path 9 is provided in tubular, and the prompt device 12 is rotationally installed or placed in the pumping water path 9. When the pumping device 7 is pumping water, the water flow passes through the position of the prompt device 12, the water flow pushes the fan blade or impeller, further drive the prompt device 12 to rotate. The user can observe the dynamic and static changes of the prompt device 12 through the visual window 11 to check whether the pumping device 7 is in the pumping state.

In other embodiments, the prompt device 12 are placed or installed floating on the pumping water path 9. When the pumping device 7 stops pumping, the prompt device 12 is located at upstream of the pumping water path 9. When the pumping device 7 is pumping, the water flow drives the prompt device 12 to move downstream. Through the visual window 11, it could be observed that before and during pumping, the prompt device 12 moves from upstream to downstream. Or, when the prompt device 12 is located upstream, prompt device 12 cannot be observed in visual window 11; when prompt device 12 moves downstream driven by water flow, it enters the visible range of visual window 11 and could be observed. Alternatively, when prompt device 12 is located upstream, it is within the visible range of visible window 11, and when prompt device 12 moves downstream, it leaves the visible range. Whether the pumping device 7 is pumping water could be checked by different position information of prompt device 12 observed in visual window 11.

Preferably, one part of the pumping water path 9 is arranged vertically, and the prompt device 12 is installed in the vertical portion of the pumping water path 9. The pumping water path 9 is provided with limited components above and below the prompt device 12 to limit the movement range of the prompt device 12. The vertical arrangement of the part of the pumping water path 9 achieves the function of pumping water from low to high, and the prompt device 12 can automatically fall to the upstream position when stops pumping.

In this embodiment, the orientation words of "upstream" and "downstream" refer to the relative positions of the water flow in pumping water path 9, that is, when the position of pumping water path 9 is near the water storage area 5, it is defined as "upstream", when the position of pumping water path 9 is near the spray head 10 or cleaning area 6, it is defined as "downstream".

In other embodiments, the prompt device 12 could also be installed on the spray head 10 or between the pumping water path 9 and the spray head 10.

In the above embodiments, in order to make the activity status or position changes of the prompt device 12 more intuitive, the prompt device 12 adopts a different color from the pumping water path 9 and the spray head 10, or at least two different colors are provided at different positions of the prompt device 12. When the prompt device 12 rotates, multiple colors are alternately displayed in the visual window 11 and different from the color displayed when it is stationary, making the dynamic information of the prompt device 12 more obvious.

Preferably, a transparent cover is provided on the visible window 11, which can prevent water flow out and maintain transparency.

Preferably, the overall spray head 10 is provided in transparency, the spray head 10 limits the upward movement of prompt device 12 at the position corresponding to the prompt device 12, thus cover is formed by the entire spray head 10, and the visible window 11 is formed corresponding to the spray head 10 in the mop bucket 2. In other embodiments, a portion of the spray head 10, which corresponds to the part of the prompt device 12, can be provided as transparent or hollow, in order to form a cover or a visible window 11.

In this embodiment, the mop rod 3 is composed of multiple segmented rods connected end-to end. The lower end of the mop rod 3 is movably connected to the mop head 4 through the positioning component, the positioning component can position the mop head 4 to be parallel or basically parallel to the mop rod 3, which facilitates the overall insertion of the flat mop rod 1 into the cleaning area 6 and achieve the function of cleaning and water squeezing. When mopping the floor, the positioning component is released, and the mop rod 3 moves freely relative to the mop head 4, the positioning component can adopt the matching structure of the top rod and the positioning groove. For example, the mop rod 3 is movably connected to the mop head 4 through the cross connecting shaft 25, one or more positioning grooves 26 are provided on the cross connecting shaft 25, the top rod 27 is movably installed on the mop rod 3, when the mop rod 3 rotates relative to the mop head 4, the top rod 27 moves along the surface of the cross connecting shaft 25 and extends into the positioning groove 26 for positioning.

In this embodiment, the squeezer 21 is located on the side close to the wiping cloth, and the support part 22 is located on the side away from the wiping cloth. The squeezer 21 can be one of the scraper, or extrusion roller, and the support part 22 can be one of the support wheel, support rib, support block, or support surface.

In order to reduce the volume of mop bucket 2 and avoid the position transfer of flat mop 1 during cleaning and squeezing, in this embodiment, mop bucket 2 is provided with the cleaning area 6 but is not provided with independent squeezing area, so that both the cleaning and squeezing of flat mop 1 are carried out in the cleaning area 6. At the same time, in order to provide cleaning water onto flat mop 1 in the cleaning area 6, the water storage area 5 is also provided on mop bucket 2, and the water in the storage area 5 flows to the cleaning area 6.

Preferably, the pumping device 7 includes the pumping sensor and the spray head 10. When the mop head 4 is inserted into the cleaning area 6 for cleaning, the pumping sensor receives the signal to pump water from the water storage area 5 by pumping device 7, then clear water is sprayed onto the wiping cloth from the spray head 10 for cleaning. When the mop head 4 switches to the squeezing state, the pumping device 7 stops pumping water, and the wiping cloth is dehydrated under the squeezing force of the squeezer 21. The water squeezed out by the wiping cloth flows downwards to the bottom of the cleaning area 6.

In this embodiment, the pumping sensor is provided in mechanically conduction, and the flat mop 1 is mechanically linked to the pumping sensor. When the flat mop 1 contacts or touches the pumping sensor, the pumping sensor drives the pumping device 7 to pump water. In other embodiments, the pumping signal can also be provided as the photoelectric signal or the electronic signal, for example, the pumping sensor can be provided as a distance sensor and achieve pumping by sensing the distance between the pumping sensor and the flat mop 1, or the pumping sensor can be provided as a current sensor, the pumping can be achieved by current connection when the flat mop 1 is in contact with the pumping sensor, or the pumping sensor can also be provided as a photoelectric sensor, etc.

Specifically, the pumping device 7 also includes the pumping pump 13 and the pumping power source, the pumping power source includes the pumping gear 14, the pumping gear 14 is arranged between the cleaning area 6 and the water storage area 5, and at least part of the pumping gear 14 are arranged within the cleaning port 18/cleaning area 6, the eccentric position of the pumping gear 14 is movably connected to the pumping connecting rod 15, and the other end of the pumping connecting rod 15 is movably connected to the pump core 16 of the pumping pump 13, the pumping gear 14 forms a pumping sensor, the length direction of the mop head 4 is provided with the first gear rack 17. When the mop head 4 passes through the cleaning port 18, the first gear rack 17 meshes with the pumping gear 14, the mop head 4 can move up and down, further drive the pumping pump 13 to pump water through the pumping power source. When the mop head 4 stops moving or the first gear rack 17 doesn't meshes with the pumping gear 14, the pumping pump 13 will stop pumping, and the mop head 4 will be transferred to the squeezing state.

In this embodiment, the first gear rack 17 is provided on the back of the mop head 4, and the water pumping power source is also provided on the side of the cleaning port 18 near the back of the mop head 4, the back side of the mop head 4 is away from the wiping cloth. The spray head 10 is provided on the side of cleaning port 18 near the wiping cloth, that is, the spray head 10 and the pumping power source are located on opposite sides of the cleaning port 18 respectively, the spray head 10 is connected to the pumping pump 13 through the pumping water path 9, the spray head 10 is provided with the spray nozzle 19, which spray the water pumped by the pumping pump 13 onto the wiping cloth, and the height of the spray nozzle 19 is not lower than the height of the pumping pump 13.

In other embodiments, the first gear rack 17 can also be provided on the side of the mop head 4, and the pumping power source can be provided at the corresponding position of the first gear rack 17.

Preferably, the spray head 10 is located above the squeezer 21, which is provided with the guide surface, the water sprayed by the spray head 10 flows along the guide surface to the wiping cloth.

The squeezer 21 is movable installed on the squeezing device 8 and move up and down under the driving force of mop head 4, and the squeezer 21 can change the distance to the wiping cloth when it is moving. Moreover, when the squeezer 21 is moving, the height of the side near the wiping cloth is always lower than the height of the side away from the wiping cloth, making it easier for the sprayed water to flow onto the wiping cloth. Specifically, there is an inclined track between the squeezer 21 and the squeezing device 8, when the mop head 4 moves up and down, it drive the squeezer 21 to move along the inclined track, thereby changing the distance between the squeezer 21 and the wiping cloth and adjusting the resistance when the mop head 4 moves up and down. In this embodiment, when the mop head 4 moves down, the distance between the squeezer 21 and the wiping cloth is the smallest, and when the mop head 4 moves up, the distance between the squeezer 21 and the wiping cloth increases, which facilitate the removal of flat mop 1 from cleaning area 6, reduce excessive resistance to the upward movement of flat mop 1 and prevent the entire mop bucket 2 from lifting up.

In this embodiment, in order to facilitate the drainage of the cleaning area 6, the mop bucket 2 is also provided with a drainage device 28, the structure of the drainage device 28 is similar to that of the pumping device 7, including a drainage sensor, a drainage water pump, and a drainage power source. The drainage sensor receive signals of flat mop 1 inserted into the cleaning area 6, further drive the drainage water pump to work and pump water.

In this embodiment, the length of the cleaning area 6 and cleaning port 18 is longer than the width of the mop head 4. When the flat mop 1 is under cleaning state, the first gear rack 17 meshes with the pumping gear 14, and the pumping device 7 sprays water onto the wiping cloth for cleaning; when the flat mop 1 is under squeezing state, it enters the cleaning area 6 along the direction that deviates from the cleaning state, the first gear rack 17 is separated from the pumping gear 14, and the water adsorbed on the wiping cloth flows out under the squeezing of the squeezer 21. The drainage device 28 discharges the water in the cleaning area 6 to avoid contact between the bottom of the wiping cloth and the water in the cleaning area 6. The wiping cloth can be squeezed to dry through multiple squeezing of the squeezer 21.

It can also be provided that the length of the cleaning area 6 matches the width of the mop head 4, the eccentric position of the mop head 4 is provided with the first gear rack 17. When in the cleaning state, the mop head 4 is rotated in the first direction to be parallel to the mop rod 3, the mop head 4 enters into the cleaning area 6, the first gear rack 17 meshes with the pumping gear 14, and the up and down movement of the mop head 4 drives the pumping device 7 to work. When in the squeezing state, the mop head 4 is rotated in the second direction opposite to the first direction to be parallel to the mop rod 3, the mop head 4 enters into the cleaning area 6, the position of the first gear rack 17 changes, and the first gear rack 17 doesn't meshes with the pumping gear 14, the up and down movement of the mop head 4 drives the drainage device 28 to work to discharge the water in the cleaning area 6.

It should be noted that in this embodiment, the mop head 4 is provided in rectangular, the length and width directions of the mop head 4 correspond to the longer and shorter directions of the mop head 4 respectively, the thickness direction is perpendicular to the wiping cloth. When entering the cleaning area 6, the length, width, and height directions of the cleaning area 6 correspond to the width, thickness, and length directions of the mop head 4 respectively.

In this embodiment, in order to achieve the separation of cleaning water and sewage, sewage area 20 is further provided in the mop bucket 2. The sewage area 20 is not connected to the water storage area 5, and the drainage device 28 is provided between the cleaning area 6 and the sewage area 20, the water in the cleaning area 6 flows into the sewage area 20 through the drainage device 28.

Preferably, the bottom of cleaning area 6 is provided with a drainage outlet, and in order to reduce the water accumulation at the bottom of cleaning area 6, the bottom surface of cleaning area 6 is inclined, so that the drainage outlet is located at the lowest position of cleaning area 6, the water in cleaning area 6 automatically flow to the position of the drainage outlet due to gravity. In this embodiment, the height of the water spray nozzle 19 is higher than the height of the drainage outlet.

In this embodiment, the drainage device 28 is provided with a one-way valve. When the water level in sewage area 20 or water storage area 5 is above the drainage outlet, the one-way valve can prevent sewage from flowing back into cleaning area 6.

In other embodiments, the structure without sewage area 20 can also be adopted. For example, both the cleaning and squeezing of the flat mop 1 are carried out within the cleaning area 6, and the sewage generated by cleaning and squeezing flows downwards to the bottom of the cleaning area 6. The bottom of the cleaning area 6 is provided with the protrusions or the surrounding frame 24 to prevent the bottom of the mop head 4 from contacting with the sewage. Alternatively, the mop bucket 2 includes the squeezing area, which is independently provided from cleaning area 6, both cleaning area 6 and the bottom of the squeezing area are provided with protrusions or the surrounding frame 24, the flat mop 1 is cleaned in cleaning area 6, and the water after cleaning flows downwards to the bottom of cleaning area 6, the flat mop 1 is squeezed in the squeezing area, and the squeezed water flows downwards to the bottom of the squeezing area or to the bottom of cleaning area 6.

In other embodiments, the mop bucket 2 includes independent squeezing area and sewage area 20, the flat mop 1 is cleaned in cleaning area 6 and squeezed in squeezing area, the sewage generated by flat mop 1 during cleaning and squeezing flows into sewage area 20.

In the above embodiment, in order to adjust the resistance of upward and downward movement of the flat mop 1 during cleaning and squeezing, at least one support groove 29 is provided in the length direction of the mop head 4. During cleaning, the mop head 4 passes through the cleaning port 18, and the support part 22 extends into the support groove 29 to support the mop head 4. During squeezing, the support part 22 is supported on the surface of the mop head 4, so that the distance between the wiping cloth and the squeezer 21 during squeezing is smaller than that during cleaning.

Specifically, the length of the cleaning port 18 is longer than the width of the mop head 4. When the support groove 29 is aligned with the position of support part 22 and inserted, the flat mop 1 enters into the cleaning state. When the support groove 29 is inserted away from the position of the support part 22, the support part 22 supports the surface of the mop head 4, and the flat mop 1 enters the squeezing water state. In other embodiments, the length of the cleaning port 18 is matched with the width of the mop head 4, and the support groove 29 is provided at the eccentric position of the mop head 4. During cleaning, the mop head 4 is rotated in the first direction to be parallel to the mop rod 3, when the mop head 4 passes through the cleaning port 18, the support part 22 extends into the support groove 29. During squeezing, the mop head 4 is rotated in the second direction opposite to the first direction to be parallel to the mop rod 3, when the mop head 4 passes through the cleaning port 18, the support part 22 is supported on the surface of the mop head 4.

Preferably, the cleaning port 18 is provided with the first guide 30 and the second guide 31 on both sides adjacent to the support part 22. The mop head 4 is matched with the first guide 30 during cleaning and the second guide 31 during water squeezing, or the mop head 4 is matched with both the first guide 30 and the second guide 31 during cleaning and water squeezing. The side of the mop head 4 is provided with the guide groove 32, and the first guide 30 and the second guide 31 can be extended into the guide groove 32 for positioning.

Embodiments of the present invention has been described in detail with reference to the accompanying drawings. While the description above refers to the particular embodiments of the present invention, it will be understood that many modifications may be made without departing from the spirit thereof. Any equivalent replacement or modification would fall within the protection scope of the present invention.

What is claimed is:

1. A mop cleaning device with visualized water spraying state, comprising a flat mop (1) and a mop bucket (2), the flat mop (1) includes a mop rod (3), a mop head (4) and one or more wiping cloths, the mop bucket (2) includes a water storage area (5) and a cleaning area (6), the water storage area (5) is connected to the cleaning area (6) through a pumping device (7), a squeezing device (8) is provided within the cleaning area (6), the squeezing device (8) is provided with a cleaning port (18), wherein the flat mop (1) drives the pumping device (7) to spray water from the water storage area (5) onto the wiping cloth for cleaning; and a squeezer (21) and a support part (22) are provided on the opposite sides of the cleaning port (18) and work together to support the mop head (4), the support part (22) comes into contact with different positions of the mop head (4) to adjust the distance between the wiping cloth and the squeezer (21), a visual window (11) and a prompt device (12) are provided on the pumping device (7), the prompt device (12) has an impeller shape and fan blades that move under the driving force of a water flow of the pumping device (7), when pumping device (7) is pumping water or stops pumping, a position information of the mop head (4) or activity status of prompt device (12) is displayed through the visual window (11).

2. The mop cleaning device with visualized water spraying state according to claim 1, wherein at least one support groove (29) is provided in the length direction of the mop head (4); wherein during cleaning, the mop head (4) passes through the cleaning port (18), and the support part (22)

extends into the at least one support groove (29) to support the mop head (4); and during squeezing, the support part (22) is supported on the surface of the mop head (4), so that the distance between the wiping cloth and the squeezer (21) during squeezing is smaller than that during cleaning.

3. The mop cleaning device with visualized water spraying state according to claim 2, wherein the length of the cleaning port (18) is longer than the width of the mop head (4), and when the at least one support groove (29) is aligned with the position of support part (22) and the support part (22) is inserted into the at least one support groove (29), the flat mop (1) enters into a cleaning state, and when the at least one support groove (29) is inserted away from the position of the support part (22), the support part (22) supports the surface of the mop head (4), and the flat mop (1) enters a squeezing water state.

4. The mop cleaning device with visualized water spraying state according to claim 1, wherein the prompt device (12) is rotatably installed in the visual window (11), the prompt device (12) is stationary when the pumping device (7) stops pumping, and the water flow drives the prompt device (12) to rotate when the pumping device (7) is pumping.

5. The mop cleaning device with visualized water spraying state according to claim 4, wherein at least two different colors are provided at different positions of the prompt device (12), and the colors displayed in the visible window (11) are different when the prompt device (12) is stationary and rotating.

6. The mop cleaning device with visualized water spraying state according to claim 1, wherein the pumping device (7) further comprises a pumping water path (9), a spray head (10), a pumping sensor, a pumping pump (13), and a pumping power source; the pumping sensor receives a signal of flat mop (1) entering into the cleaning area (6), and drives the pumping pump (13) to work and pump water; wherein the pumping sensor can be provided as photoconduction or mechanically conduction.

7. The mop cleaning device with visualized water spraying state according to claim 6, wherein the pumping power source includes a pumping gear (14), the pumping gear (14) is arranged between the cleaning area (6) and the water storage area (5), and at least part of the pumping gear (14) are arranged within the cleaning area (6), an eccentric position of the pumping gear (14) is movably connected to a pumping connection rod (15), and the other end of the pumping connection rod (15) is movably connected to a pump core (16) of the pumping pump (13), the length direction of the mop head (4) is provided with a first gear rack (17); when the mop head (4) passes through the cleaning port (18), the first gear rack (17) meshes with the pumping gear (14), the mop head (4) move up and down, further drive the pumping pump (13) to pump water through the pumping power source.

8. The mop cleaning device with visualized water spraying state according to claim 7, wherein the spray head (10) and the pumping gear (14) are arranged in different directions of the cleaning port (18), the spray head (10) is connected to the pumping pump (13) through the pumping water path (9), the spray head (10) is provided with a spray nozzle (19), which spray the water pumped by the pumping pump (13) onto the wiping cloth, and the height of the spray nozzle (19) is not lower than the height of the pumping pump (13).

9. The mop cleaning device with visualized water spraying state according to claim 1, wherein both the cleaning and squeezing of the flat mop (1) are carried out within the cleaning area (6), the bottom of the cleaning area (6) is provided with one or more protrusions or a surrounding frame (24), wherein the cleaning and squeezing of the flat mop generates sewage, and the sewage generated by the cleaning and squeezing of the flat mop (1) flows downwards to the bottom of the cleaning area (6).

* * * * *